United States Patent [19]

Wilkening

[11] 4,310,411

[45] Jan. 12, 1982

[54] CATALYTIC CRACKING

[75] Inventor: Gregory C. Wilkening, West Columbia, Tex.

[73] Assignee: Phillips Petroleum Company, Bartlesville, Okla.

[21] Appl. No.: 118,833

[22] Filed: Feb. 5, 1980

Related U.S. Application Data

[63] Continuation-in-part of Ser. No. 932,890, Aug. 10, 1978, abandoned.

[51] Int. Cl.[3] ..... C10G 11/18

[52] U.S. Cl. ..... 208/153; 208/164; 422/214

[58] Field of Search ..... 208/153, 164; 422/214

[56] References Cited

U.S. PATENT DOCUMENTS

| | | | |
|---|---|---|---|
| 2,901,420 | 8/1959 | Evans | 208/153 |
| 3,041,273 | 6/1962 | Smith et al. | 208/153 |
| 3,607,127 | 9/1971 | Pfeiffer | 208/164 |
| 4,064,038 | 12/1977 | Vermilion | 208/164 |
| 4,070,159 | 1/1978 | Myers et al. | 208/161 X |
| 4,149,964 | 4/1979 | Bartholic | 208/153 |
| 4,219,407 | 8/1980 | Haddad et al. | 208/151 |

*Primary Examiner*—Curtis R. Davis
*Assistant Examiner*—G. E. Schmitkons

[57] ABSTRACT

In a transfer line catalytic cracking reaction system having a riser-reactor provided with a vertical section and a horizontal section, the improvement for minimizing erosion in the system which comprises cracking with a high velocity of reactant and catalyst in the vertical portion of the riser and a lower velocity in the lateral or horizontal section of the reactor prior to introduction of reactant effluent into catalyst separation zone(s).

9 Claims, 1 Drawing Figure

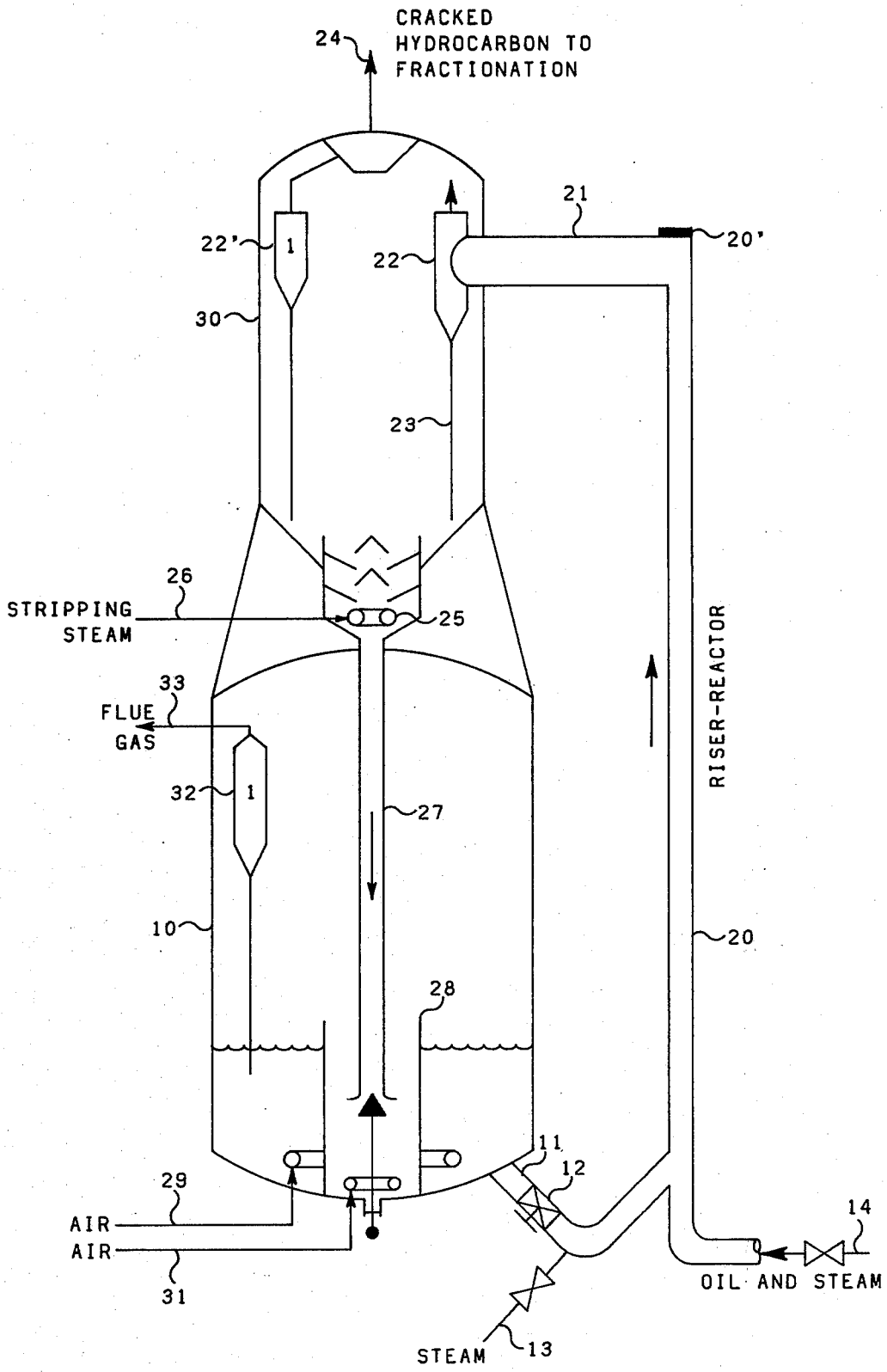
CRACKED
HYDROCARBON TO
FRACTIONATION
24
21
20'
22'
1
22
30
23
26
STRIPPING
STEAM
25
33
FLUE
GAS
32
1
27
RISER-REACTOR
10
20
28
11
12
29
AIR
AIR
31
14
OIL AND STEAM
STEAM
13

CATALYTIC CRACKING

This is a continuation-in-part application of copending application Ser. No. 932,890, filed Aug. 10, 1978, and now abandoned.

This invention relates to an improved catalytic cracking reactor system and process for cracking hydrocarbon-containing materials. In accordance with another aspect, this invention relates to a transfer line catalytic cracking riser-reactor having a vertical section and a horizontal section wherein the cross-sectional area of the horizontal section is larger than the vertical section so as to provide a lower flow velocity in the horizontal section. In accordance with another aspect, this invention relates to a process for cracking hydrocarbon-containing materials in a riser-reactor system having a vertical section and a horizontal section wherein the flow velocity of reactant and catalyst in the vertical portion is at a higher rate than the flow rate of reactant and catalyst in the horizontal section so that the reaction effluent passed to the catalyst separation zone is introduced at a flow rate such that erosion of equipment is minimized.

In recent years the process of catalytic cracking of gas oils and heavier petroleum stocks to produce gasoline and light olefins has been significantly improved by the development of improved cracking systems. One such cracking system is the riser-type or transfer line reactors which have many advantages over other systems and are a well-known type of catalytic cracking operation. One problem encountered in the riser-type of transfer line reactors is attrition of catalyst and erosion of the catalyst separators to which the riser-reactor effluent is introduced for separation of catalyst for regeneration from the catalytic cracked product. The present invention is directed to an improved riser-reactor whereby erosion of equipment is minimized.

Accordingly, an object of this invention is to provide an improved riser-reactor apparatus useful for cracking hydrocarbon oils.

Another object of this invention is to provide an improved process whereby flow velocities through the riser-reactor are so controlled that erosion of equipment is minimized.

Other objects, aspects, and the several advantages of the invention will become apparent to those skilled in the art upon a study of the specification, the drawing, and the appended claims.

In accordance with the invention, an improved catalytic cracking process is provided having a riser-reactor wherein a high flow velocity of hydrocarbon reactant and catalyst is employed in the vertical portion of the riser and a lower velocity of reactant and catalyst in the lateral or horizontal portion of the reactor and introducing reactant effluent containing catalyst into the catalyst separation units under conditions whereby erosion is minimized.

In accordance with one specific embodiment, an elongated cylindrical transfer line catalytic cracking riser-reactor system is provided having a vertical section of a smaller cross-sectional area than the horizontal section for introduction of effluent into a catalyst separation unit so that erosion of the horizontal section and the catalyst separation is minimized.

In accordance with another specific embodiment, the flow velocity of catalyst and hydrocarbon reactant in the vertical section of a riser-reactor is in the range of about 65 to about 90 feet per second and the flow velocity in the horizontal section is less than about 65 feet per second and less than the flow velocity of the vertical section so that erosion of the horizontal section and, in particular, in catalyst separation units is minimized.

The apparatus of this invention allows a riser-type reaction zone to be designed in a manner which allows the effluent material from the riser-type reaction zone which comprises catalyst and cracked products to pass into cyclone separation units located within a separation vessel for the relatively quick separation of catalyst and hydrocarbons under conditions such that erosion of the catalyst separation units, e.g., cyclones, is minimized. The present invention employs two or more sets of cyclone separators to separate catalyst from cracked products.

The reaction zone, regeneration zone, and separation zones along with all inlet and outlet lines and all transfer lines which are included as part of the apparatus of the present invention can be constructed of any suitable material. The metals used in the construction of the various parts of the apparatus should be of such a nature as to withstand temperatures greater than 600° F. and not be easily worn away by contact with the small particle size catalysts. Typical of the metals which can be used include carbon steel with erosion-resistant linings, stainless steel metals and various metals derived therefrom including metals containing chromium and nickel.

The present invention has its greatest advantage in application to catalytic cracking of heavy petroleum hydrocarbon stocks. Typical stocks are light and heavy gas oils obtained by primary distillation, vacuum distillation, and the like, from crude oils of various sources and reduced crudes. The boiling range, e.g., 450° to 650° F. for light gas oils and 650° to 850° F. or even higher for heavy gas oils.

Catalyst for catalytic cracking include known types including silica-alumina or silica-magnesia synthetic microspheres or ground gels and various natural clay type or synthetic gel type catalysts.

A better understanding of the invention will be obtained upon reference to the accompanying drawing which illustrates schematically the described process and apparatus.

Referring to the drawing, the apparatus depicted shows a regenerator 10, riser-reactor having a vertical tubular section 20 and horizontal tubular section 21 and a catalyst disengaging vessel 30 which is provided with catalyst separation units 22, e.g., cyclones. The separated used or spent catalyst is regenerated in regenerator 10 by contact with air introduced at 29 and 31 under suitable conditions to burn off the coke and hydrocarbon deposits remaining on the catalyst. Regenerator 10 is ordinarily operated at a temperature in the range of about 1100°–1500° F.

Regenerated catalyst is removed from a lower portion of regenerator 10 by way of line 11 and the rate of withdrawal is controlled by slide valve 12. At the elbow of withdrawal line 11 is an inlet conduit 13 for introduction of steam 13, if needed, to move catalyst through line 11 into a lower portion of vertical section 20 of the riser-reactor. Oil and steam are introduced through valved line 14 into the base or lower portion of vertical reaction section 20.

Hot regenerated catalyst, oil, and steam are contacted in the lower portion of vertical reaction section 20 and passed upwardly at a flow velocity in the range of about 65 to about 90 feet per second which is sufficient to minimize recirculation or backflow of catalyst in the vertical leg. The cross-sectional area or diameter of vertical riser-reactor 20 is sized such that the flow of reactant and catalyst through section 20 falls within the range of 65 to 90 feet per second. The reaction time, for example, for a topped crude oil feed to be in contact with catalyst in vertical riser-reactor 20 can be in the range of 1.6 to 2.2 seconds.

The top of vertical section 20 is connected to horizontal section 21 which is of greater cross-sectional area than the vertical section 20 so that the flow velocity of reactant and catalyst in the horizontal section is less than about 65 feet per second, preferably less than about 60 feet per second, but always less than the flow rate in vertical section 20. The horizontal velocity is sufficiently high to prevent catalyst drop out, but low enough to avoid erosion of the cyclone separator inlet. Horizontal section 21 is connected to vertical section 20 at a right angle. Preferably, sections 20 and 21 are cylindrical. In actual installation, the vertical section 20 and the horizontal section 21 can vary a few degrees from vertical and horizontal, respectively. A conventional erosion protected elbow 20' is used between vertical section 20 and horizontal section 21.

The effluent from riser-reactor 20 and 21 is introduced into one or more cyclone separators 22 located within catalyst disengaging vessel 30. The reaction effluent is introduced into the cyclone separators in such a manner as to separate catalyst from the cracked hydrocarbon products. Catalyst is withdrawn from a lower portion of each cyclone 22 by way of dip leg 23 and cracked hydrocarbon product is passed via second cyclones 22' to fractionation (not shown) by way of line 24.

Used separated catalyst collects in a lower portion of vessel 30 in stripping section 25 and is countercurrently contacted with stripping steam introduced by line 26 for removal of residual amounts of occluded cracked hydrocarbon from the catalyst. Stripped materials and steam are removed overhead through cyclones 22' and by way of line 24.

Stripped used separated catalyst is passed by way of line 27 to a lower portion of regenerator 10 wherein it is contacted with preheated air introduced by line 31 which lifts catalyst from well 28 to the annulus wherein it is contacted with heated air introduced by line 29. The air in line 29 can be heated to a temperature of about 440° F., or higher, and serves as combustion air for burning coke and other carbonaceous deposits from the catalyst surfaces in the annulus and lower portion of regenerator 10. Flue gas is removed from regenerator 10 via cyclones 32 and conduit 33 for disposal.

The conditions obtaining in riser-reactor 20 and 21 are well known and within the skill of the art. However, ordinarily, the temperature in riser-reactor 20 will be in the range of 880° F. to 1030° F. with a hydrocarbon to steam weight ratio of about 10:1 to about 25:1 and a catalyst to hydrocarbon weight ratio of about 5:1 to about 8:1. Pressure in riser-reactor 20 will be in the range of about 10 to about 60 psia. As indicated previously, the flow velocity in the vertical section of riser-reactor will be in the range of about 65 to 90 feet per second and the horizontal flow velocity will be in the range of 50 to 65 feet per second, but preferably less than 60 feet per second. In any event, the flow velocity in the vertical section will be at a higher rate than in the horizontal section.

The total reaction time in both the riser and horizontal runs depends on many factors, including:

(a) type of oil, e.g., light cycle or heavy cycle oil requiring more time than less refractory virgin gas oil or (still less) topped crude;

(b) type of catalyst (activity); and (c) reaction temperature (catalyst temperature and catalyst-to-oil ratio).

Thus, broadly, the total reaction time for both the vertical and horizontal reaction sections can range from about 2 seconds for topped crude up to about 5 seconds for cycle oils.

The reaction time in a preferred embodiment employing a topped crude feed in the vertical portion will be in the range of 1.6 to 2.2 and in the horizontal section 0.43 to 0.56 seconds. The total reaction time in this embodiment for both the vertical and horizontal sections will be about 2 to about 3 seconds, more often 2.76 seconds.

The ratio of the cross-sectional area of the vertical riser to the cross-sectional area of the horizontal section based on the average flow velocities in both the vertical and horizontal sections ranges from at least about 0.5 up to about 1. Using average velocities set forth herein and wherein area of flow times time of flow is constant, the ratio can be determined as follows:

$$\frac{\text{Area Vertical}}{\text{Area Horizontal}} = \frac{50}{90} = 0.5$$

to $$\frac{\text{Area Vertical}}{\text{Area of Horizontal}} = \frac{65}{65} = < \text{about } 1$$

In one specific embodiment of the invention, the vertical riser-reactor 20 and 21 described in the drawing has a length of 143 feet and the horizontal section has a length of 28 feet with the vertical section being 50 inches in diameter and the horizontal section being 56 inches in diameter.

The following calculated operation describes and sets forth various conditions for the reaction system set forth in the drawing:

Calculated Operation

| | | Ranges (Where Appropriate) | Specific |
|---|---|---|---|
| (14) | Topped Crude, B/H | — | 2,085 |
| | °API at 60° F., | — | 19.3 |
| | Steam Added at 466° F., lb/hr, | — | 40,000 |
| | Oil Temperature, °F., | — | 500 |
| (13) | Optional Steam, lb/hr, | — | 1,800 |
| | Temperature, °F. | — | 466 |
| (11) | Regenerated Catalyst: | | |
| | Tons/hour, | — | 2,400 |
| | Temperature, °F., | 1150–1450 | 1,400 |
| (29) | Air for Regeneration: | | |
| | Pounds/hour, | — | 957,700 |
| | Temperature, °F., | — | 440 |
| | Pressure, psia, | — | 54.8 |
| (31) | Air to Lift Catalyst: | | |
| | Pounds/hour, | — | 4,600 |
| | Temperature, °F., | — | 200 |
| | Pressure, psia, | — | 100 |
| (10) | Conditions in Regenerator: | | |
| | Pressure, psia, | 10–60 | 47.6 |
| | Temperature, °F. | 1150–1450 | 1,400 |
| | Diameter, feet, (I.D.,), | — | 48.83 |
| | Length, feet, (approximately), | — | 110 |
| (20) | Riser-Reactor: | | |
| | Vertical Length, feet, | — | 143 |
| | Diameter, inches, (I.D.), | — | 50 |
| | Velocity, feet/sec., | 65 to 90 | 70 |

-continued

| Calculated Operation | | Ranges (Where Appropriate) | Specific |
|---|---|---|---|
| | Reaction time, sec., | 1.6 to 2.2 | 2.04 |
| (21) | Horizontal Length, feet, | 25 to 35 | 28 |
| | Diameter, inches, (I.D.), | — | 56 |
| | Velocity, feet/sec., | 50 to 65 | 60 |
| | Reaction time, sec., | 0.43 to 0.56 | 0.47 |
| Total Reaction Time, sec., | | 2.03 to 2.76 | 2.51 |
| (30) | Disengaging Vessel: | | |
| | Pressure, psia, | 10–60 | 42.3 |
| | Temperature, °F., | 880–1030 | 970 |
| | Diameter, feet, (I.D.), | — | 27.33 |
| | Length, feet, (approximately), | — | 70 |

Note:

There are 16 to 32 2-stage cyclones in the top zone of regenerator 10; there are 4 riser cyclones in parallel, and about 16 secondary cyclones, in cyclone vessel 30 to which riser-reactor is fed by reactor lateral conduit.

The invention gives desired total reactor contact time by adjusting vertical riser velocity and by maintaining horizontal velocity to a level so as to not erode to any great degree the primary cyclones 22. This horizontal velocity is preferably less than 65 feet/second, e.g., 60 feet/second, and still effects proper cyclones operations.

I claim:

1. An elongated transfer line catalytic cracking riser-reactor system comprising, in combination, a substantially vertical tubular cylindrical section having an inlet end connected to a catalyst regenerator and an oil inlet, a substantially horizontal tubular cylindrical section connected to the upper end of said vertical section and having an outlet end connected to a catalyst separator vessel for separation and return of catalyst to said regenerator and wherein the cross-sectional area of said vertical section of the reactor is less than the cross-sectional area of the horizontal section of the reactor which feeds the catalyst separator vessel so that the flow velocity in said horizontal section is somewhat less than said vertical section to substantially prevent and minimize erosion of the horizontal section and catalyst separator, said vertical section and said horizontal section being so sized that the ratio of the cross-sectional area of the vertical riser to the cross-sectional area of the horizontal section based on the average flow velocities in both the vertical and horizontal sections ranges from at least about 0.5 up to about 1.

2. An apparatus according to claim 1 wherein the cross-sectional area of said vertical section is such that the average flow velocity within the vertical section is within the range of about 65 to about 90 feet per second and the cross-sectional area of the horizontal section is such that the average flow velocity in the horizontal section is in the range of 50 to 65 feet per second but less than the flow velocity in the vertical section.

3. A catalytic cracking system comprising in combination:

a substantially vertical cylindrical section of a riser-reactor having an inlet end connected to an oil feed inlet and an outlet from a catalyst regeneration unit, a substantially horizontal cylindrical section of said riser-reactor attached to the upper end of the vertical section and in open communication therewith and an outlet end on said horizontal section connected to a catalyst separation vessel, an outlet in an upper portion of the catalyst separation vessel for removal of separated cracked product and an outlet in the lower portion of said catalyst separation vessel for passage of used catalyst to the regeneration zone, air inlets in the lower portion of said regeneration zone for introduction of air under conditions to burn combustibles on the catalyst and an outlet in the lower portion of said regeneration zone connected to a lower portion of the vertical section of the riser-reactor for passage of regenerated catalyst to the riser-reactor for contact with reactant oil under cracking conditions with the proviso that the cross-sectional area of the vertical section is less than the cross-sectional area of the horizontal section so that the flow velocity in the horizontal section is less than about 65 feet per second and the ratio of the cross-sectional area of the vertical riser to the cross-sectional area of the horizontal section based on the average flow velocities in both the vertical and horizontal sections ranges from at least about 0.5 up to about 1, thereby minimizing erosion of catalyst separation units within the catalyst separation vessel.

4. An apparatus according to claim 3 wherein, the cross-sectional area of the vertical section of said riser-reactor is such that the average flow velocity within the vertical section is in the range of about 65–90 feet per second and the cross-sectional area of the horizontal section is such that the average flow velocity is below about 60 feet per second.

5. An apparatus according to claim 3 wherein said vertical section has a diameter of about 50 inches and a length of about 143 feet and said horizontal section has a diameter of about 56 inches and a length of about 28 feet.

6. A process for the catalytic conversion of hydrocarbons which comprises the steps of:

introducing hot regenerated catalyst and a preheated hydrocarbon reactant feed into a lower portion of a riser-reaction zone having a substantially vertical tubular cylindrical section and a substantially horizontal tubular cylindrical section and passing catalyst and reactant feed upwardly through said vertical section at an average flow velocity in the range of about 65 to about 90 feet per second, passing the effluent from said vertical section through said horizontal section at an average flow velocity in the range of about 50 to about 65 feet per second but less than the flow velocity in said vertical section, the total reaction time in said vertical and horizontal sections being in the range of about 2 to about 5 seconds, introducing the effluent from said horizontal section into a catalyst separation zone to separate cracked hydrocarbon products from catalyst, and returning separated catalyst to the regeneration zone for regeneration and subsequent reintroduction into the vertical section of said riser-reactor.

7. A process according to claim 6 wherein the reactant feed is a topped crude.

8. A process according to claim 6 wherein the reactant feed is a topped crude and the total reaction time in the vertical and horizontal sections is in the range of about 2 to about 3 seconds.

9. A process according to claim 6 wherein the horizontal flow velocity is less than about 60 feet per second.

* * * * *